US005132699A

United States Patent [19]

Rupp et al.

[11] Patent Number: 5,132,699

[45] Date of Patent: Jul. 21, 1992

[54] INFLATABLE ANTENNA

[75] Inventors: Richard B. Rupp, Lockport; Richard J. Blum, Buffalo; Anthony V. Alongi, Niagara Falls, all of N.Y.

[73] Assignee: LTV Aerospace and Defense Co., Dallas, Tex.

[21] Appl. No.: 615,963

[22] Filed: Nov. 19, 1990

[51] Int. Cl.[5] ..... H01Q 1/08

[52] U.S. Cl. ..... 343/880; 343/415

[58] Field of Search ..... 343/880, 915, 912, 916, 343/878, 879; 342/10

[56] References Cited

U.S. PATENT DOCUMENTS

| | | | |
|---|---|---|---|
| 2,270,314 | 1/1942 | Kraus | 343/915 |
| 3,005,987 | 10/1961 | Mack et al. | 343/915 |
| 3,170,471 | 2/1965 | Schnitzer | 343/915 |
| 3,264,649 | 8/1966 | White | 343/915 |
| 3,326,624 | 6/1967 | Maydell et al. | 343/915 |
| 3,742,513 | 6/1973 | Ehrenspeck | 343/915 |
| 3,867,019 | 2/1975 | Eyerman | 343/915 |

*Primary Examiner*—Michael C. Wimer
*Assistant Examiner*—Hoanganh Le
*Attorney, Agent, or Firm*—Brooks & Kushman

[57] ABSTRACT

Provided is a collapsible antenna formed of one or more generally planar and vertically inclined inflatable panels. According to the invention, each of the panels has a continuous outer wall, a continuous inner wall and a plurality of web partitions extending between the inner and outer walls to form a series of tubular members. The inner wall of the collapsible antenna is at least partially covered by a metallic material and a plurality of dipole elements are affixed to the web partitions and spaced from the inner wall in a predetermined relationship such that the antenna will operate at a preselected frequency when inflated.

22 Claims, 1 Drawing Sheet

INFLATABLE ANTENNA

TECHNICAL FIELD

This invention relates to antenna systems, and more particularly, to an inflatable antenna.

BACKGROUND ART

Inflatable structures have been effectively used to suspend and support radar reflectors and antennas in various environments. One commonly used type of inflatable structure is an inflatable radar reflector incorporated within a life raft. For example, see U.S. Pat. No. 3,130,406 issued to Jones-Hinton. Each of the several embodiments illustrated in the '406 patent comprise a circular sheet of flexible material having at least one circular central section reflective of radio waves and an inflatable endless tube which encircles the sheet to hold the center section taut and flat when the tube is inflated.

Similarly, see U.S. Pat. No. 4,475,109 issued to Dumas which discloses an inflatable antenna for use with a buoy at sea. The Dumas antenna comprises a closed inflatable compartment having a top section coated with conductive material in selected areas on the inside of the compartment to form capacitive loading portions. There is further disclosed flexible webs in the inflatable compartments which are selectively coated with conductive material to provide the vertical blade for each radiating element. As disclosed by Dumas, the radiating elements of the antenna are formed by conductive metalized portions of the antenna fabric.

Inflatable antennas have also been used to support land radar antennas and reflectors for radio waves. See, for example, U.S. Pat. No. 2,913,726 issued to Curry. The Curry patent discloses an inflatable antenna assembly comprising a pair of paraboloids joined at their rims to form an inflatable housing supported in an upright position on a rotatable base. As disclosed by Curry, one of the paraboloids has its inner surface coated with reflective material so that when the housing is inflated, the coated paraboloid assumes the configuration of a parabolic antenna reflector. Curry also discloses a radome for the inflatable antenna comprising a spherical structure of neoprenecoated nylon to be mounted and inflated directly on the ground.

U.S. Pat. No. 3,005,987 issued to Mack discloses an inflatable antenna assembly comprising an elliptical tubular member having sheets of flexible nonconducting material fastened to opposite sides of the tube to form an enclosure.

U.S. Pat. No. 3,115,631 issued to Martin discloses an inflatable reflector for radio waves comprising a base of double pile textile fabric having outer sheets which are rendered substantially impermeable to gas and are tied together in a parallel-spaced relation by pile threads. The threads are woven through the fabric and form a chamber which can be inflated. Upon inflation, sheets of flexible radio reflecting material which are secured therein become taut and held flat in a mutually perpendicular relation.

U.S. Pat. No. 3,170,471 issued to Schnitzer discloses an inflatable honey-comb element for use in making up structures which are foldable and inflatable. The element comprises a collapsible, inflatable structure which has flexible outer skin members and flexible inner core members which are perpendicularly disposed to divide the element into a plurality of cells. The panel structure may be fabricated of a thin, lightweight flexible plastic film or sheet which may further have a thin layer of metal placed thereon to strengthen the plastic and to reflect the light and radio wave.

Finally, U.S. Pat. No. 3,176,302 issued to Tipton discloses an inflatable variable band with antenna having an inflatable tubular ring which supports a flexible diaphragm. The diaphragm comprises nonconductive fabric and parallel, spaced elastic flexible conductive strips secured by their ends to the periphery of the housing.

While each of the above structures are light-weight and inflatable, they are, for the most part, difficult to deploy and dismantle.

DISCLOSURE OF THE INVENTION

In accordance with the present invention, there is provided an inflatable antenna formed of one or more generally planar and vertically inclined inflatable panels, each having a continuous outer wall, a continuous inner wall and a plurality of web partitions extending between the inner and outer walls to form a series of tubular members. In a preferred embodiment of the invention, the inner and outer walls may be corrugated such that the tubular members formed by the web partitions are cartouche-shaped in cross section, having parallel side walls and semi-circular ends.

According to applicants' invention, the inner wall of the inflatable antenna is at least partially covered by a metallic material. A plurality of dipole elements are further affixed to the web partitions and spaced from the inner wall in a predetermined relationship such that the antenna will operate at a preselected frequency.

The antenna of the present invention is also collapsible and is designed to be deployed quickly and easily from a non-inflated storage position.

In a first embodiment of the invention, two generally planar and vertically inclined inflatable panels with the structural design described above are connected along a common edge to form an A-frame structure to obtain surveillance in azimuth sections from 315° to 45° and 135° to 225°.

In a second embodiment of the invention, two of the A-frame structures are spaced at a 90° angle to each other to form an antenna assembly having a complete 360° azimuth surveillance.

Accordingly, it is an object of the present invention to provide a collapsible antenna formed of one or more generally planar and vertically inclined inflatable panels which may be easily stored in a non-inflated position, yet quickly and easily inflated and deployed.

It is a further object of the invention to provide a collapsible antenna which may be deflated, dismantled and stored for reuse.

BRIEF DESCRIPTION OF THE DRAWING

The present invention can be more completely understood by reference to the accompanying drawings in which.

BEST MODE FOR CARRYING OUT THE INVENTION

Figure 1:
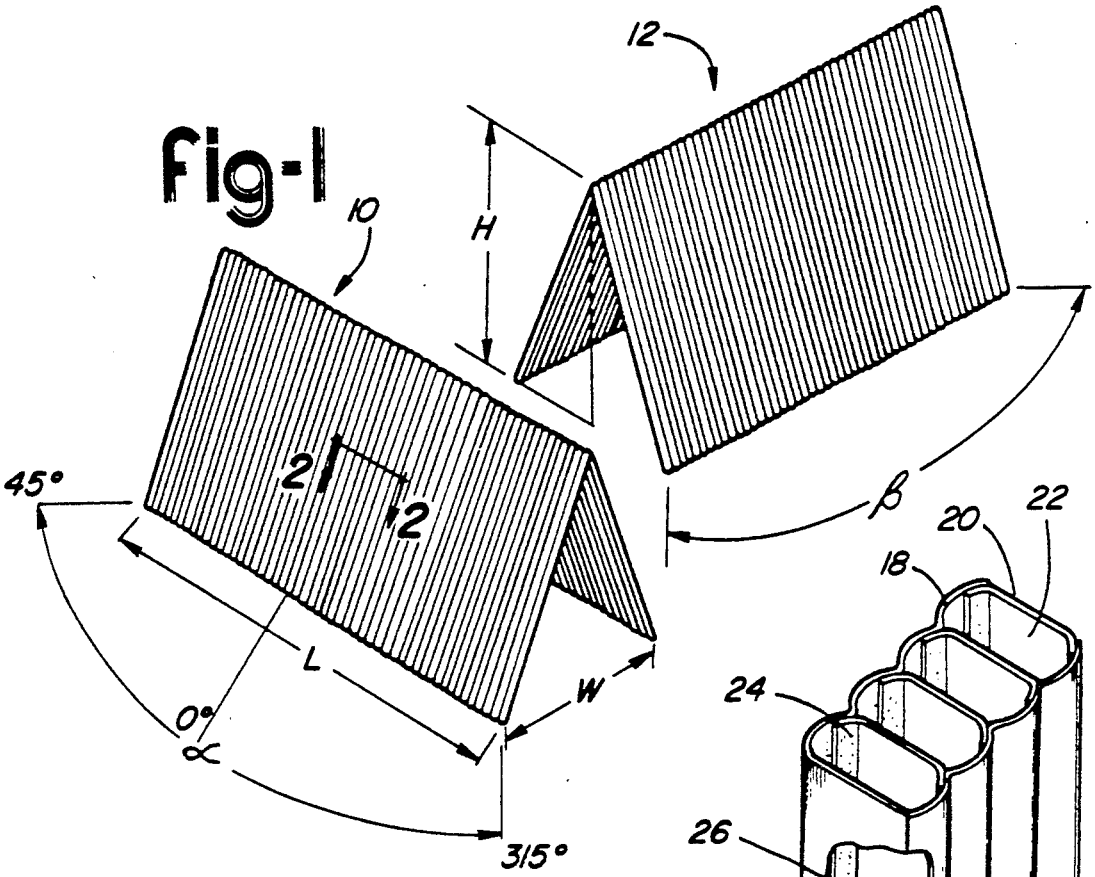
FIG. 1 is a perspective view illustrating a preferred embodiment of two antenna structures.

With reference to FIG. 1 of the drawings, a pair of collapsible A-frame antenna structures 10 and 12 are shown having length L, a base width W and a base height H. Antenna structures 10 and 12 are shown spaced apart and in a 90° relation to each other. In a preferred embodiment, antenna structures 10 and 12 are, for example, fifty to eighty feet in length, sixteen to twenty feet wide and thirty to thirty-seven feet high. The two A frame structures are sufficiently separated (e.g. 300 feet) so that one structure does not appreciably block antenna pattern coverage of the other.

As further indicated at FIG. 1, each of the respective antenna structures 10 and 12 provide wide area, electronically scanned, surveillance coverage over plus or minus fifty degree sectors to the front and rear of the antenna structures. This arrangement provides for coverage about a 180° area as designated by greek numerals $\alpha$ and $\beta$, respectively. The combined effect of the antenna structure arrangement is to cover an entire 360° surveillance area. Less than 360° coverage could be achieved with two closely spaced A-frame structures, or only one such structure.

Figure 2:
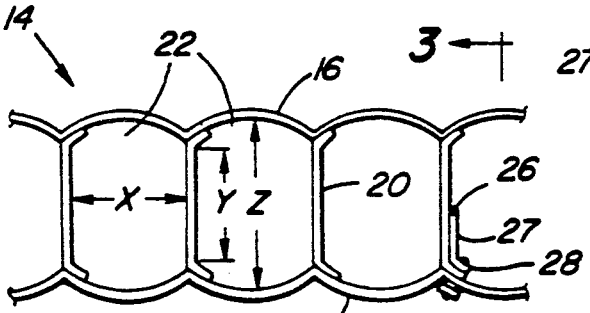
FIG. 2 is a cross-sectional plan view of the tubular members of FIG. 1 in cross section along the line 2—2.
Figure 3:
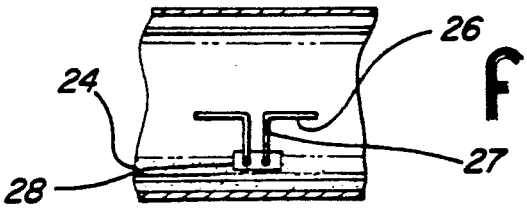
FIG. 3 is a partial view of the tubular members of FIG. 2 along line 3—3, enlarged to show the dipole members of the invention.

Referring now to FIGS. 2 and 3, the inflatable antenna of the invention contains a continuous outer wall 16 and a continuous metalized inner wall 18 separated by a plurality of generally parallel web partitions 20 having length Y to define a series of tubular members 22. Tubular members 22 are further disclosed having diameter Z and width X.

When inflated, as in the preferred embodiment shown in FIG. 2, the diameter Z of the tubular members 22 is greater than its width X and greater also than the length Y of the web partitions. Thus, $Z>X$ and $Z>Y$. The dimension "X" is also preferably equal to approximately 0.55 times the wavelength of the antenna to provide up to ±75° azimuth electronic scan without grating lobes. For example, a 15-inch spacing between the webs provides a 0.55 wavelength array column spacing for operation at 430 MHZ. However, it is recognized that, in accordance with the teachings of the present invention, different spacing will be required for operation at other frequencies.

Figure 4:
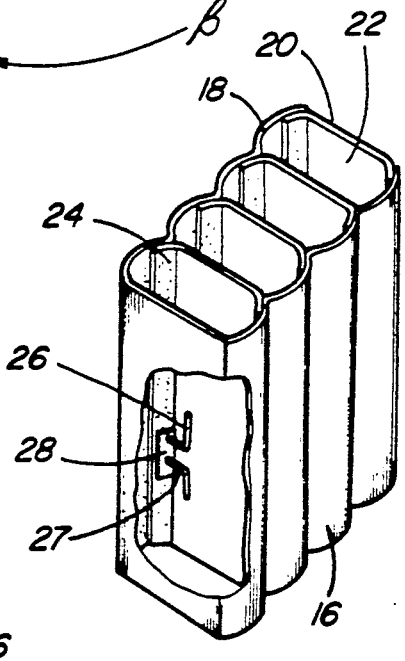
FIG. 4 is a perspective view of the tubular members of FIG. 1, enlarged and partially cut-away to illustrate the placement of the dipole members of the invention.

With reference now to FIGS. 3 and 4, the inner wall 18 is disclosed to be at least partially covered by a metallic material 24. A plurality of dipole elements 26 are affixed to the web partitions and spaced a predetermined distance from the inner wall.

In accordance with the present invention, each tube 22 of the antenna is further disclosed to be inflated to a predetermined diameter at a predetermined internal pressure. The diameter and internal pressure are selected to provide, when inflated, a moment of inertia and resistance to bending that will limit the deformation of the antenna once subjected to environmental loadings such as wind, snow and ice loads.

It is appreciated by those skilled in the art, that permissible deformation, complete surface and local, are limited by the electrical performance requirements of the antenna. In the preferred embodiment, the tubes 22 are inflated to minimize such deformations.

It should be appreciated that the dual-wall air supported structure disclosed by applicants provides an ideal media for embedding a phased-array antenna because the inner wall 18 and the interconnecting web partitions 20 between the outer wall 16 and the inner wall 18 can be used to provide mechanical support for the antenna elements.

In a preferred embodiment, vertical dipoles 26 are mounted on the web partitions 20 approximately ¼ of a wavelength in front of a metalled inner wall to achieve optimum performance specifications. Each dipole feeds a twin-line balanced-to-ground 27 which runs orthogonal to the inner wall 18 to a terminal block 28. The inner wall 18 acts as a ground plane and it is further contemplated that a transmit/receive (T/R) module or a transmission line will be connected to the terminal block. As an alternative, twin feed line 27 and terminal block 28 could be replaced by a standard quarter wave coaxial balun.

Referring again to FIG. 2, it is seen that in a preferred embodiment the outer and inner walls 16 and 18 are corrugated such that tubular members 22 are cartouche-shaped in cross section, having parallel side walls and semi-circular ends. These are the natural shapes due to inflation of the structure.

In operation, it is contemplated that the inflatable antenna of the invention will be deployed by the apparatus and method for deploying an inflatable antenna disclosed by applicants in U.S. Ser. No. 615,961, filed Nov. 19, 1990, which is commonly owned with this application and is incorporated herein by reference.

While the best modes for carrying out the invention have been described in detail, those familiar with the art to which this invention relates will recognize alternative designs and embodiments for practicing the invention as defined by the following claims.

What is claimed is:

1. A collapsible antenna, comprising:

a generally planar inflatable panel formed of a continuous outer wall, a continuous inner wall, said inner wall at least partially covered by a metallic material and a plurality of generally parallel web partitions extending between said outer wall and said inner wall to define a series of tubular members; and a plurality of dipole elements affixed to said web partitions and spaced from said inner wall such that the antenna will operate at a predetermined frequency.

2. A collapsible antenna as in claim wherein said inflatable panel has length L and height H such that $L>H$.

3. A collapsible antenna as in claim wherein said inner and outer walls are corrugated such that a series of tubular members are formed which are cartouche in cross section, having parallel side walls and semi-circular ends in said panel by said web partitions.

4. A collapsible antenna as in claim 3, wherein said tubular members have diameter Z and said web partitions have length Y such that $Z>Y$.

5. A collapsible antenna as in claim 4, wherein said web partitions are spaced apart a distance X such that $Z>X$.

6. A collapsible antenna as in claim 5, wherein said distance X is selected such that $X\approx 0.55$ the antenna wavelength.

7. A collapsible antenna as in claim 5, wherein said distance X is approximately 15 inches.

8. A collapsible antenna, comprising:

a first generally planar inflatable panel formed of a continuous outer wall and a continuous inner wall, said inner wall at least partially covered by a metallic material and a plurality of generally parallel web partitions extending between said outer wall and said inner wall to define a series of tubular members;

a second generally planar inflatable panel formed of a continuous outer wall and a continuous inner wall, said inner wall at least partially covered by a metallic material, and a plurality of generally parallel web partitions extending between said outer wall and said inner wall to define a series of tubular members, wherein said first and second inflatable panels are connected along a common edge to form an A-frame structure; and a plurality of dipole elements affixed to the respective web partitions of said first and second inflatable panels and spaced from the respective inner walls such that the antenna will operate at a predetermined frequency.

9. A collapsible antenna as in claim 8, wherein said first and second inflatable panels are vertically inclined.

10. A collapsible antenna as in claim 8, wherein said A-frame structure has a length L and height H such that $L>H$.

11. A collapsible antenna as in claim 10, wherein said A-frame structure has a base height H such that $L>2H$.

12. A collapsible antenna as in claim 8, wherein said inner and outer walls of said first and second inflatable panels are corrugated such that a series of cartouche tubular members are formed in each of said panels by said respective web partitions which are cartouche in cross section, having parallel side walls and semi-circular ends.

13. A collapsible antenna as in claim 12, wherein said tubular members have diameter Z and said web partitions have length Y such that $Z>Y$.

14. A collapsible antenna as in claim 12, wherein said web partitions are spaced apart a distance X such that $Z>X$.

15. A collapsible antenna as in claim 14, wherein the distance X is selected such that $X\approx 0.55$ the antenna wavelength.

16. A collapsible wide-area surveillance antenna assembly comprising:

a first generally planar inflatable panel formed of a continuous outer wall and a continuous inner wall, said inner wall at least partially covered by a metallic material and a plurality of generally parallel web partitions extending between said outer wall and said inner wall to define a series of tubular members which are cartouche in cross section, having parallel side walls and semi-circular ends;

a second generally planar inflatable panel formed of a continuous outer wall and a continuous inner wall, said inner wall at least partially covered by a metallic material and a plurality of generally parallel web partitions extending between said outer wall and said inner wall to define a series of tubular members which are cartouche in cross section, having parallel side walls and semi-circular ends, wherein said first and second inflatable panels are connected along a common edge to form a first A-frame structure;

a third generally planar inflatable panel formed of a continuous outer wall and a continuous inner wall, said inner wall at least partially covered by a metallic material and a plurality of generally parallel web partitions extending between said outer wall and said inner wall to define a series of tubular members which are cartouche in cross section, having parallel side walls and semi-circular ends;

a fourth generally planar inflatable panel formed of a continuous outer wall and a continuous inner wall, said inner wall at least partially covered by a metallic material and a plurality of generally parallel web partitions extending between said outer wall and said inner wall to define a series of tubular members which are cartouche in cross section, having parallel side walls and semi-circular ends, wherein said third and fourth inflatable panels are connected along a common edge to form a second A-frame structure, said second A-frame structure positioned sufficiently perpendicular to said first A-frame structure and sufficiently far apart to achieve wide-area surveillance over a 360° sector; and a plurality of dipole elements affixed to the web partitions of the respective first, second, third and fourth inflatable panels and spaced from the respective inner walls such that the antenna assembly will operate at a predetermined frequency.

17. A collapsible antenna assembly as in claim 16, wherein said first and second antenna structures have length L, and height H such that $L>H$.

18. A collapsible antenna assembly as in claim 17, wherein said first and second A-frame structures have base height H such that $L>2H$.

19. A collapsible antenna assembly as in claim 16, wherein said inflatable panels are vertically inclined.

20. A collapsible antenna assembly as in claim 16, wherein said tubular members have diameter Z and said web partitions have length Y such that $Z>Y$.

21. A collapsible antenna assembly as in claim 20, wherein said web partitions are spaced apart a distance X such that $Z>X$.

22. A collapsible antenna assembly as in claim 21, wherein said distance X is selected such that $X\approx 0.55$ the antenna wavelength.

* * * * *